US011045374B2

(12) United States Patent
Wakabayashi et al.

(10) Patent No.: US 11,045,374 B2
(45) Date of Patent: Jun. 29, 2021

(54) INCUBATOR

(71) Applicant: ATOM MEDICAL CORPORATION, Tokyo (JP)

(72) Inventors: Keisuke Wakabayashi, Saitama (JP); Kenji Kobayashi, Saitama (JP); Ichiro Matsubara, Tokyo (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 178 days.

(21) Appl. No.: 16/480,820

(22) PCT Filed: Jan. 29, 2018

(86) PCT No.: PCT/JP2018/002654

§ 371 (c)(1),
(2) Date: Jul. 25, 2019

(87) PCT Pub. No.: WO2018/139630

PCT Pub. Date: Aug. 2, 2018

(65) Prior Publication Data

US 2019/0388292 A1 Dec. 26, 2019

(30) Foreign Application Priority Data

Jan. 30, 2017 (JP) ..... JP2017-014034

(51) Int. Cl.
*A61G 11/00* (2006.01)

(52) U.S. Cl.
CPC ..... *A61G 11/009* (2013.01); *A61G 11/00* (2013.01); *A61G 11/005* (2013.01); *A61G 2200/14* (2013.01); *A61G 2203/46* (2013.01)

(58) Field of Classification Search
CPC ..... A61G 11/00
See application file for complete search history.

(56) References Cited

U.S. PATENT DOCUMENTS 5,242,375 A * 9/1993 McDonough ..... A61G 11/00 600/22
2013/0345494 A1* 12/2013 Matsubara ..... A61G 11/00 600/22

FOREIGN PATENT DOCUMENTS

JP S60-135544 U 9/1985
JP 2001-070367 A 3/2001
JP 2001-515758 A 9/2001

(Continued)

*Primary Examiner* — John P Lacyk
(74) *Attorney, Agent, or Firm* — Brinks Gilson & Lione

(57) ABSTRACT

An incubator includes an incubator main body, a baby accommodation chamber disposed in the incubator main body and capable of being shielded from external air, and a humidifier disposed in the incubator main body so as to generate steam for supplying humidified air into the baby accommodation chamber. The humidifier has a connection portion to which a water supply hose is connectable so as to supply water for generating the steam from a water supply container located outside the incubator main body. In addition, the humidifier includes a humidifying tank which stores the water for generating the steam, a water supply port portion which supplies the water into the humidifying tank in communication with the connection portion, and a float valve which opens and closes the water supply port portion by moving upward and downward in response to a water level of the water stored inside the humidifying tank.

6 Claims, 12 Drawing Sheets

(56) References Cited

FOREIGN PATENT DOCUMENTS

| | | | |
|---|---|---|---|
| JP | 2004-275378 | A | 10/2004 |
| JP | 2010-096426 | A | 4/2010 |
| JP | 2013-002797 | A | 1/2013 |
| JP | 59-56257 | B2 | 7/2016 |

* cited by examiner

INCUBATOR

RELATED APPLICATIONS

This application is a 371 application of PCT/JP2018/002654 having an international filing date of Jan. 29, 2018, which claims priority to JP2017-014034 filed Jan. 30, 2017, the entire content of each of which is incorporated herein by reference.

BACKGROUND OF THE INVENTION

1. Field of the Invention

The present invention relates to an incubator capable of incubating a baby inside a baby accommodation chamber which can be shielded from external air.

2. Description of the Related Art

In a closed-type incubator for incubating a baby in an environment shielded from external air includes a humidifier which adjusts humidity of air to be supplied to a baby accommodation chamber for accommodating the baby in order to always maintain substantially constant humidity of the baby accommodation chamber. For such a humidifier, in order to facilitate water supply to the humidifier, a configuration in which the humidifier is attachable to and detachable from an incubator main body has been proposed.

For example, Patent Document 1 or Patent Document 2 discloses an incubator including a detachable humidifier. The incubators include a water storage tank which is attachable to and detachable from a humidifying tank (water tank) of the humidifier (heating type humidifier). Water is supplied into the humidifying tank from an inside of the water storage tank. Steam is generated by heating the water in a heating unit disposed inside the humidifying tank so as to humidify the air. In addition, the humidifying tank has a water level sensor which detects a water level of the water supplied into the humidifying tank so that the water level inside the humidifying tank can be controlled up to a predetermined depth. In addition, according to the incubator including the humidifier, as disclosed in Patent Document 1, the steam is continuously generated in the humidifier, when no more water remains inside the water storage tank and the water level inside the humidifying tank drops below a top portion of the water level sensor, an alarm is issued. Therefore, an operator detaches the humidifier from the incubator main body in response to the alarm. The operator can continuously humidify the air by supplying the water to the water storage tank, or can clean the humidifying tank of the humidifier.

3. Prior Art Documents

Patent Documents

Patent Document 1: Japanese Unexamined Patent Application, First publication No. 2001-70367

Patent Document 2: Japanese Patent (Granted) Publication No. 5956257

SUMMARY OF THE INVENTION

Technical Problem to be Solved by Invention

In this way, as the humidifier included in the incubator, a configuration including a detachable water storage tank is adopted. However, according to the humidifier including the water storage tank, if the humidifier is detached from the incubator main body and the water storage tank is not further detached from the humidifying tank, the water cannot be supplied to the water storage tank. Consequently, it takes time and effort to supply the water, and the work becomes complicated. In addition, when the water is supplied to the water storage tank, the humidifier is detached from the incubator main body. Accordingly, the humidifier temporarily stops humidifying the air, thereby causing a possibility that the humidity of the baby accommodation chamber may fluctuate. In addition, the operator cannot recognize the amount of the water stored inside the humidifying tank until the alarm is issued by the water level sensor. Therefore, in a case where a response of the operator is delayed, there is a possibility that the humidity of the baby accommodation chamber may fluctuate. Furthermore, each time the water is supplied to the water storage tank, a plurality of the operators touch the humidifying tank. Consequently, it is difficult to ensure satisfactory hygienic conditions.

In addition, when the humidifier is attached to and detached from the incubator main body, operation noise or shock may occur, thereby causing stress on the baby accommodated in the baby accommodation chamber. In addition, when the humidifier is attached thereto or detached therefrom, there is a possibility that the water remaining inside the humidifying tank may spill around the incubator. In addition, in the humidifying tank, a cap of a water supply tank is likely to become hot due to heated water. Therefore, when the water storage tank needs to be supplied with the water, it is difficult to immediately supply the water.

The present invention is made in view of the above-described circumstances, and aims to provide an incubator which can continuously humidify air and can stably supply hygienic air to a baby accommodation chamber.

Solution to Problem

According to the present invention, there is provided an incubator including an incubator main body, a baby accommodation chamber disposed in the incubator main body and capable of being shielded from external air, and a humidifier disposed in the incubator main body so as to generate steam for supplying humidified air into the baby accommodation chamber. The humidifier has a connection portion to which a water supply hose is connectable so as to supply water for generating the steam from a water supply container located outside the incubator main body. The humidifier includes a humidifying tank which stores the water for generating the steam, a water supply port portion which supplies the water into the humidifying tank in communication with the connection portion, and a float valve which opens and closes the water supply port portion by moving upward and downward in response to a water level of the water stored inside the humidifying tank. The float valve includes a guide shaft portion and an arm portion. The guide shaft portion is disposed substantially vertically in an axial direction, and an upper end portion of the guide shaft portion has a valve body capable of coming into contact with the water supply port portion. The arm portion is disposed to be rotatable around a base end portion by using the base end portion as a fulcrum, a tip portion of the arm portion has a float movable upward and downward by using buoyancy in response to the water level of the water stored inside the humidifying tank, and the arm portion is rotatably connected to a lower end portion of the guide shaft portion by a joint portion disposed at a position closer to the base end portion than the float. The guide shaft portion is disposed so as to be movable upward and downward in conjunction with upward and downward movement of the joint portion. When the float moves upward, the valve body comes into contact with the water supply port portion so as to close the water supply port portion. When the float moves downward, the valve body is separated from the water supply port portion so as to open the water supply port portion.

In the incubator according to the present invention, the water can be supplied to the humidifier from the water supply container located outside the incubator main body. Accordingly, an operator does not need to detach the humidifier from the incubator main body, and can supply the water to the water supply container or can easily replace the water supply container with another water supply container having the water stored therein. Therefore, the water can be continuously supplied to the humidifier, and humidified air can be stably and continuously supplied to the baby accommodation chamber.

In addition, when the operator replaces the water supply container, the operator does not need to detach the humidifier from the incubator main body. Accordingly, the operator does not touch the humidifying tank of the humidifier. Therefore, satisfactory hygienic conditions of the humidifying tank can be ensured, and hygienic air can be stably supplied to the baby accommodation chamber. Furthermore, unless the humidifier is detached from the incubator main body, there is no operation noise or shock caused by the attachment and detachment of the humidifier. Accordingly, it is possible to alleviate stress on a baby accommodated in the baby accommodation chamber. The humidifier may be detached from the incubator main body only when cleaning work is carried out. The humidifying tank can be easily and reliably cleaned and disinfected by detaching the humidifier from the incubator main body.

In addition, as the water supply container, for example, the operator uses a container formed so that a remaining amount of the internally stored water can be visually confirmed such as a container formed of a transparent member. Accordingly, the operator can easily confirm the remaining amount of the water stored inside the water supply container. In this case, the operator can recognize in advance a timing to replace the water supply container without waiting for an alarm. The operator can supply the water to the water supply container, and can prepare for replacing the water supply container with another water supply container having the water stored therein. Since the operator can prepare the replacement in this way, the water can be smoothly and quickly supplied to the water supply container. Without stopping the water supply to the humidifier, the operator easily and continuously supplies the humidified air to the baby accommodation chamber.

In addition, in the incubator according to the present invention, the humidifier has the float valve, and the water is automatically supplied into the humidifying tank by opening and closing the water supply port portion in accordance with the upward and downward movement of the float valve. Accordingly, the water level inside the humidifying tank can be kept constant. Therefore, the water can be continuously supplied from the water supply container to the humidifier, and the humidified air can be stably and continuously supplied to the baby accommodation chamber.

In addition, the arm portion of the float valve has the float (power point) in which buoyancy is applied to the tip portion by using the base end portion as a fulcrum. The joint portion (point of action) to which the guide shaft portion is connected is disposed at the position closer to the base end portion (fulcrum) than the float (power point). In this way, the arm portion is disposed so that a distance from the base end portion (fulcrum) to the float (power point) that is farther than a distance from the base end portion (fulcrum) to the joint portion (point of action). In this manner, when a weak force (buoyancy) is applied to the float (power point), a force stronger than a force applied to the float (power point) can be applied to the joint portion (point of action). Therefore, in the humidifier, the water supply port portion can be reliably closed so as to stop the water supply by using the float valve, and the water can be prevented from being excessively supplied into the humidifying tank. Therefore, in the humidifier, the water supply port portion can be reliably closed and opened in conjunction with the upward movement and the downward movement of the float.

The water supply container is located at a position higher than the water supply port portion of the humidifier. In this manner, the water can be supplied into the humidifying tank by utilizing gravity generated due to the height (gravity supply method). In this case, the water can be supplied to the humidifier by adopting a simple configuration without providing means for forcibly supplying the water, such as a water pump.

As a preferred embodiment of the incubator according to the present invention, the arm portion may have a bilaterally symmetrical shape, and a pair of the base end portions may be disposed in a rightward-leftward direction.

The arm portion is caused to have the bilaterally symmetrical shape, and the pair of base end portions is disposed in the rightward-leftward direction. In this manner, it is possible to suppress inclination of the float when the buoyancy is applied to the float (power point). Therefore, the arm portion can be stably rotated around the base end portion (fulcrum). The water supply and the water supply stop can be reliably switched by the float valve.

In the incubator according to the present invention, the humidifier may include a water level sensor which detects the water level of the water stored inside the humidifying tank.

In a case where the water is not properly supplied to the humidifier, humidification efficiency may become poor, thereby causing a possibility that the air may not be sufficiently humidified. In addition, there is a possibility that so-called no-water heating phenomenon may appear where the humidifying tank is heated in a state where no water exists inside the humidifying tank. Therefore, the water level sensor which detects the water level of the water stored inside the humidifying tank is disposed therein. In this manner, when the water level drops below a predetermined water level, a warning is issued so as to inform the operator of an abnormal water level inside the humidifying tank. Accordingly, the operator can take various safety measures by reliably supplying the water into the humidifying tank or by forcibly stopping the heating performed by the humidifier. In this manner, the no-water heating can be prevented, and the humidified air can be stably supplied to the baby accommodation chamber.

As a preferred embodiment of the incubator according to the present invention, the water level sensors may be respectively attached to two positions having mutually different depths of the humidifying tank.

The water level can be checked in two stages by using the water level sensors respectively attached to the two positions having the mutually different depths of the humidifying tank. Therefore, the operator can take various safety measures in two stages.

As a preferred embodiment of the incubator according to the present invention, a central portion of the float in the rightward-leftward direction may have a recessed portion formed to be recessed in a forward-rearward direction orthogonal to the rightward-leftward direction. The water level sensor may be arranged inside the recessed portion.

The recessed portions are respectively formed in front of and behind the float, and the two water level sensors are respectively located inside the recessed portions. In this manner, the plurality of water level sensors can be arranged even in a limited space inside the humidifying tank.

As a preferred embodiment of the incubator according to the present invention, a bottom surface portion of the humidifying tank may be formed so that the depth of one side portion in the forward-rearward direction is shallow and the depth of the other side portion is deep, and an inclined surface is formed between the one side portion and the other side portion. The water level sensors may be respectively attached to two locations of the inclined surface.

The water level sensors are respectively attached to the two locations of the inclined surface formed on the bottom surface portion of the humidifying tank. In this manner, the respective water level sensors can be easily arranged at positions having the mutually different depths of the humidifying tank.

Advantageous Effects of Invention

According to the present invention, air can be continuously humidified, and hygienic air can be stably supplied to a baby accommodation chamber.

DETAILED DESCRIPTION OF THE PREFERRED EMBODIMENTS

Hereinafter, an incubator according to an embodiment of the present invention will be described with reference to the drawings.

Figure 1:
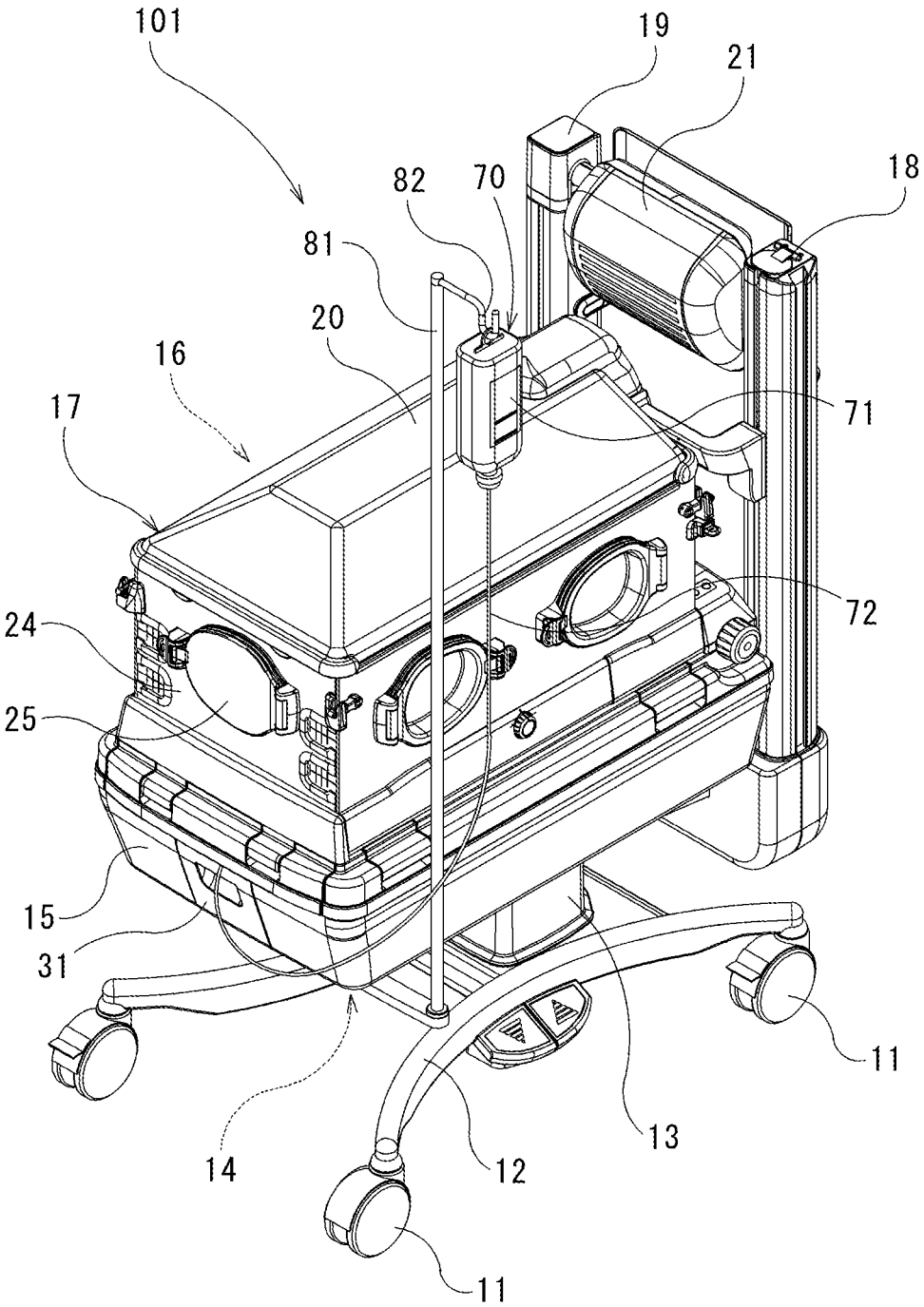
FIG. 1 is an external perspective view of an incubator, which illustrates an embodiment according to the present invention.
Figure 3:
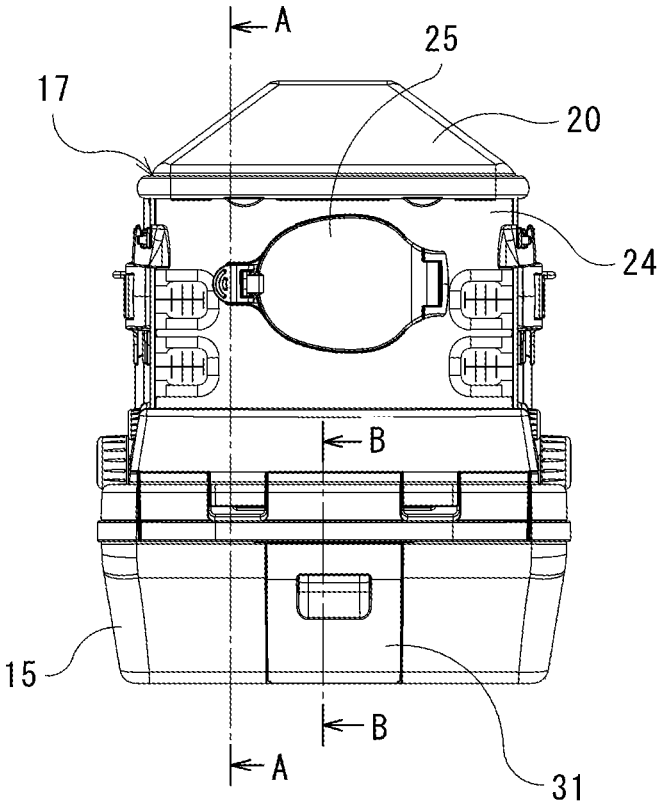
FIG. 3 is a front view of a main part of the incubator when viewed from a left side in FIG. 2.
Figure 4:
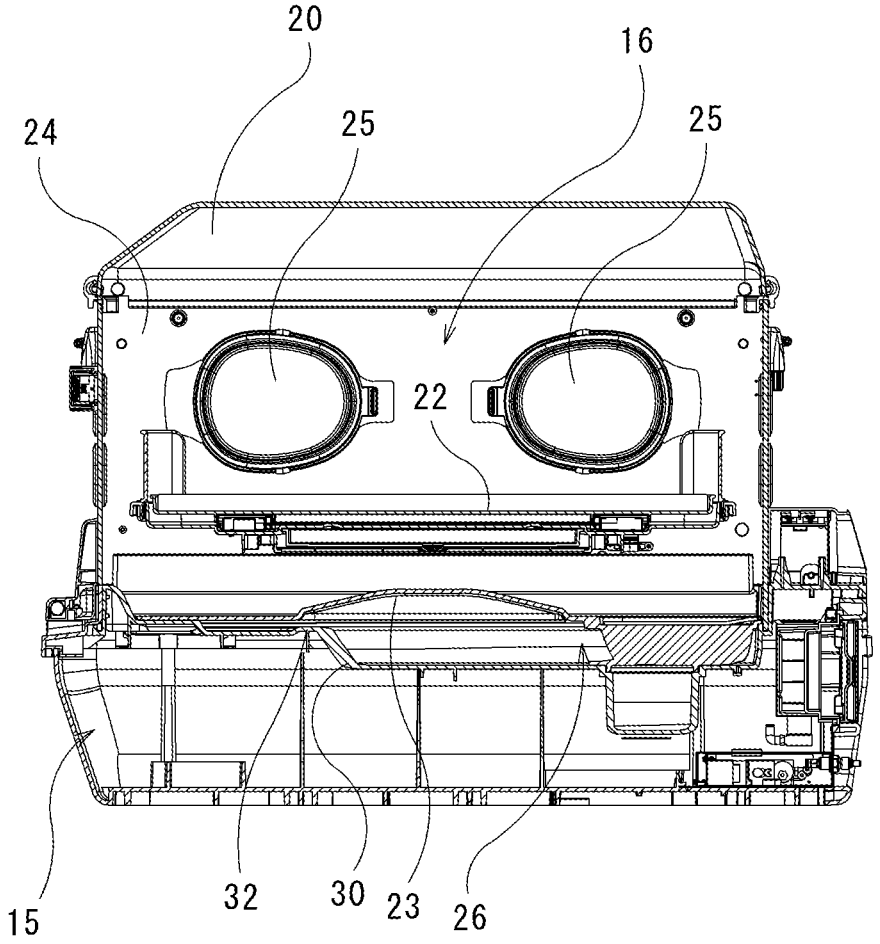
FIG. 4 is a sectional view of a main part of the incubator, which is taken along line A-A in FIG. 3.

As totally illustrated in FIG. 1, an incubator 101 according to the present embodiment includes a pedestal 12 movable by using a caster 11, a support pillar 13 vertically erected on the pedestal 12, a frame 14 disposed in an upper end of the support pillar 13, a base 15 installed on the frame 14, a hood 17 disposed on the base 15 and surrounding a baby accommodation chamber 16, two guide pillars 18 and 19 vertically disposed at side positions of the hood 17 in one end portion of the frame 14, a canopy (ceiling hood) 20 attached to an upper end of the guide pillar 18 and configuring a ceiling of the hood 17, and an air heater 21 attached to an upper end of the guide pillar 19. In the incubator 101 according to the present embodiment, each portion of the base 15 and the hood 17 which are arrayed on the frame 14 corresponds to an incubator main body according to the present invention. FIG. 3 is a front view of a main part of the incubator 101, and FIG. 4 is a sectional view of the main part of the incubator 101.

The hood 17 is configured to have a substantially rectangular shape by using a floor plate 23 on which a bed base 22 is installed to lay a baby thereon, respective treatment doors 24 arranged on a right side, a left side, a foot side, and a head side of the baby, and a canopy 20 which closes an upper portion of the baby accommodation chamber 16 surrounded by the treatment doors 24. Sealing members are respectively arranged among the floor plate 23 forming the hood 17, the respective treatment doors 24, and the canopy 20. In this way, it is possible to form the baby accommodation chamber 16 shielded from external air. In addition, substantially all of the respective treatment doors 24 and the canopy 20 are formed of a transparent resin, thereby enabling the baby inside the baby accommodation chamber 16 to be visually confirmed from the outside.

FIGS. 1 to 4 illustrate the incubator 101 in a state where the hood 17 is closed by lowering the canopy 20. In the incubator 101, the upper portion of the baby accommodation chamber 16 can be opened by raising the canopy 20, or the respective treatment doors except the foot side can be opened. In this case, the baby accommodation chamber 16 can be heated by using the air heater 21. In addition, in a state of a closed-type incubator in which the hood 17 is closed, an operator inserts a hand into the baby accommodation chamber 16 through a maintenance window 25 disposed in the respective treatment doors 24. In this manner, the operator can treat the baby while the respective treatment doors 24 remain closed.

Figure 7:
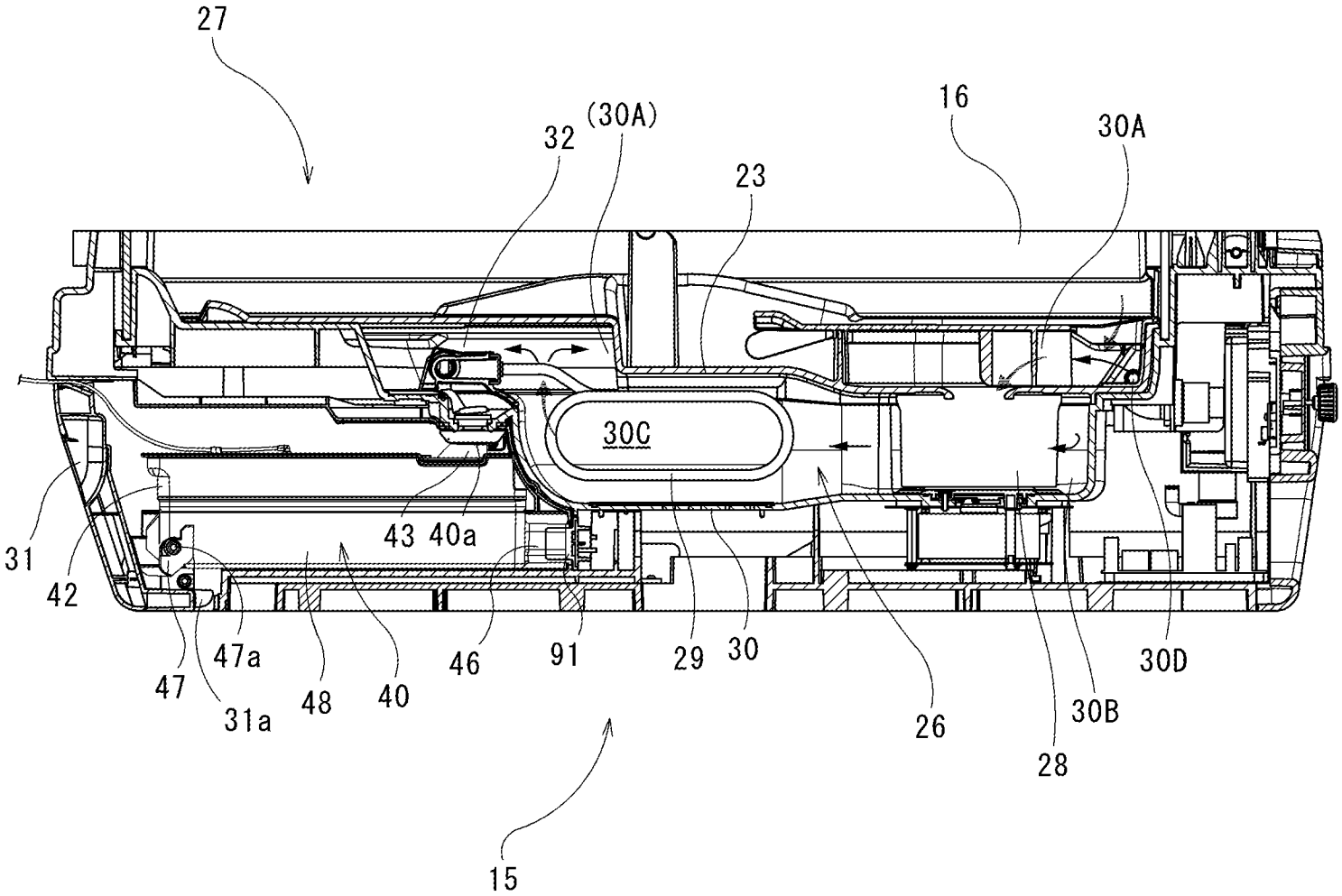
FIG. 7 is a sectional view of a main part of the incubator, which is taken along line B-B in FIG. 3.

As illustrated in the sectional view of the base 15 in FIG. 7, a harmonizing tank 26 communicating with the baby accommodation chamber 16 is provided in a lower portion of the baby accommodation chamber 16, that is, inside the base 15. An air conditioner 27 is provided so that air whose temperature and humidity are harmonized through the harmonizing tank 26 is circulated in the baby accommodation chamber 16. The air conditioner 27 includes a fan 28 which moves the air in the harmonizing tank 26, a heater 29 which heats the air in the harmonizing tank 26, and a humidifier 40 disposed to be attachable to and detachable from a harmonizing tank bottom plate (harmonizing tank configuration member) 30 configuring the harmonizing tank 26 and supplying the steam to the air in the harmonizing tank 26. The air whose temperature and humidity are harmonized can be circulated for the baby accommodation chamber 16.

Figure 2:
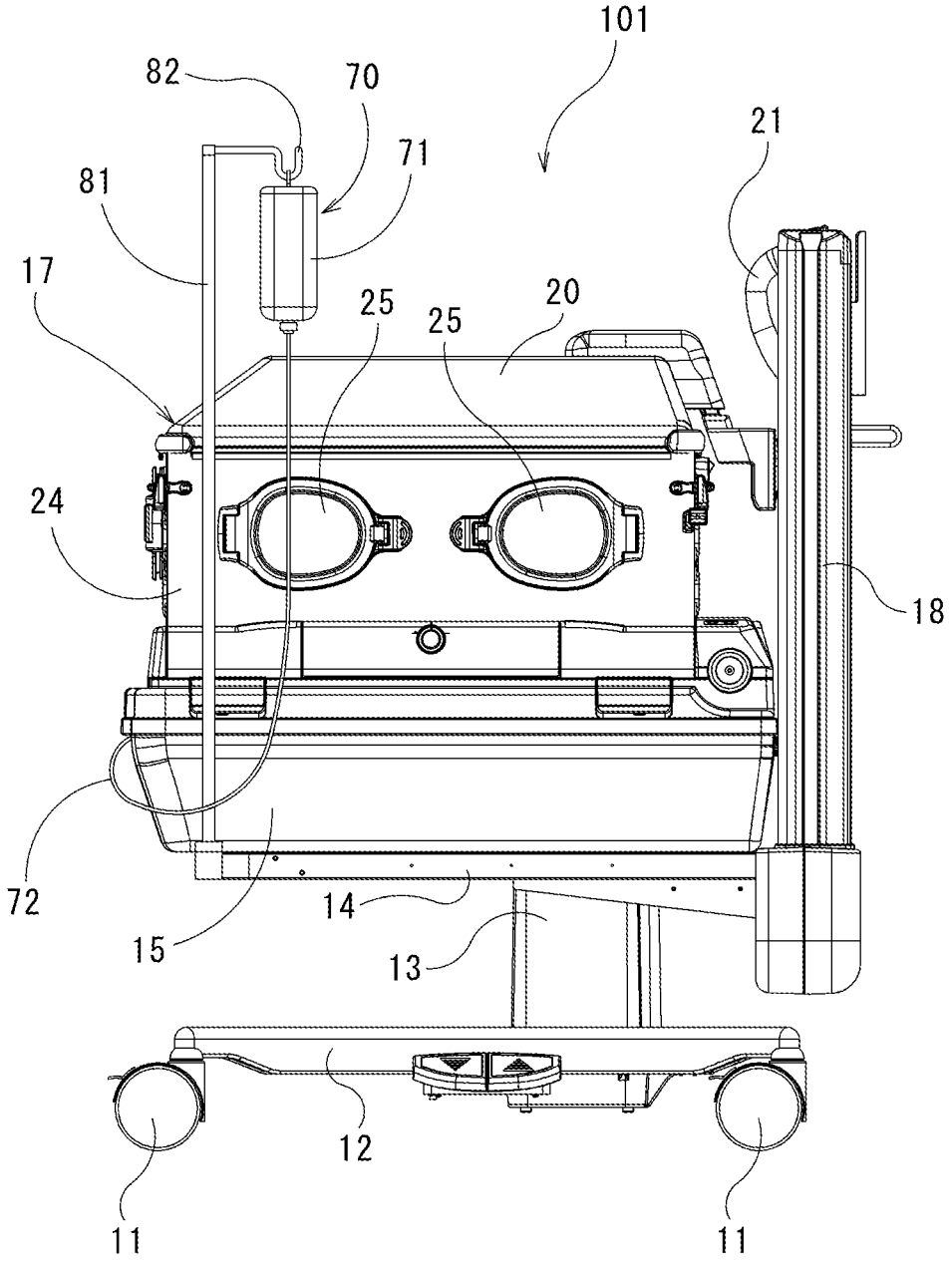
FIG. 2 is a side view of the incubator illustrated in FIG. 1.
Figure 11:
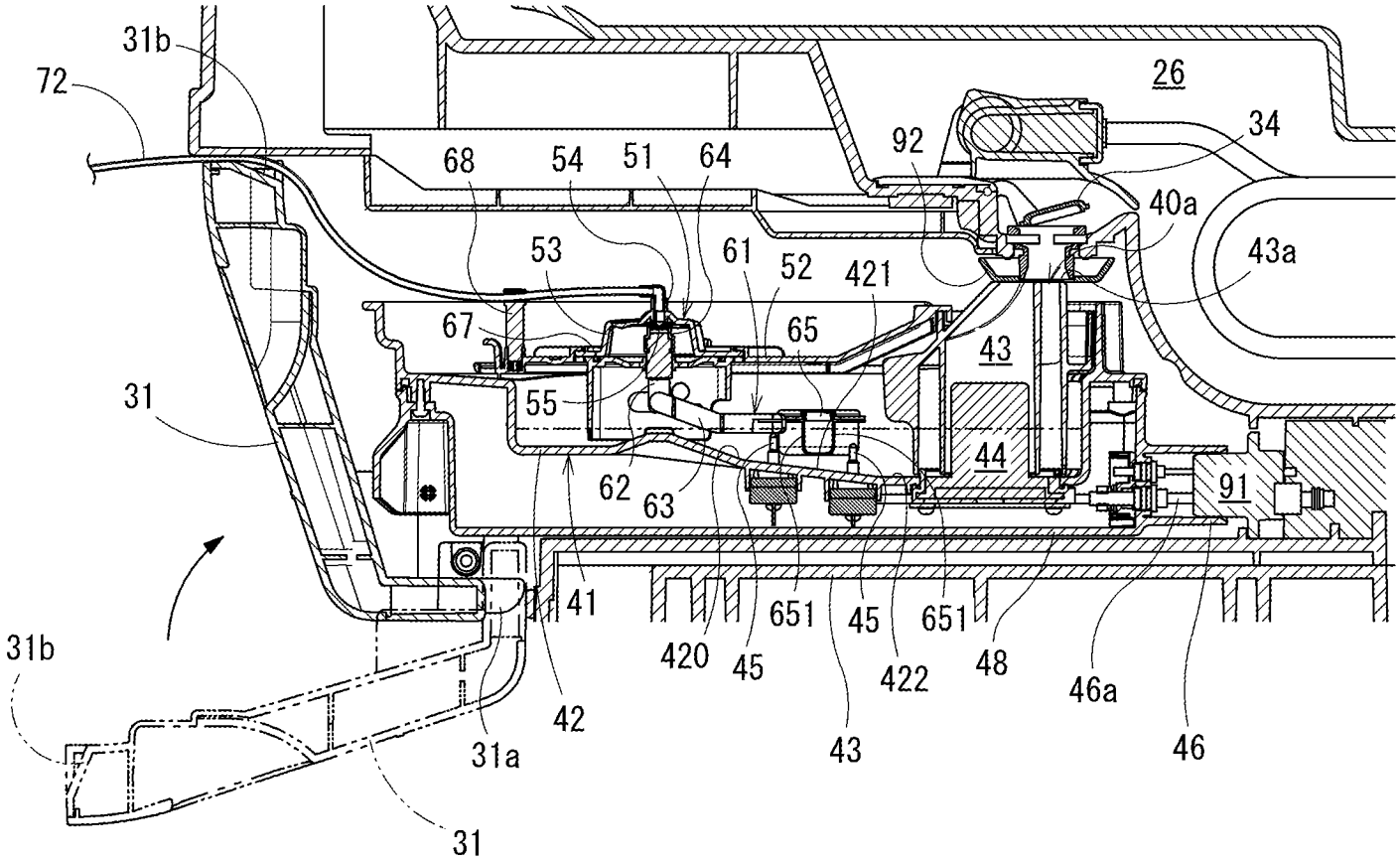
FIG. 11 is a sectional view of a main part of the incubator for describing the humidifier to be attached to and detached from a base.

The base 15 includes a base door 31 which is opened and closed when the humidifier 40 is detached from the harmonizing tank bottom plate 30. As illustrated in FIG. 11, the base door 31 is closed, thereby allowing the humidifier 40 to be accommodated inside the base 15. In addition, in the incubator 101, as illustrated in FIGS. 1 and 2, a water supply unit 70 for supplying the water to the humidifier 40 is attached to an outer portion of the base 15 which accommodates the humidifier 40.

Figure 5:
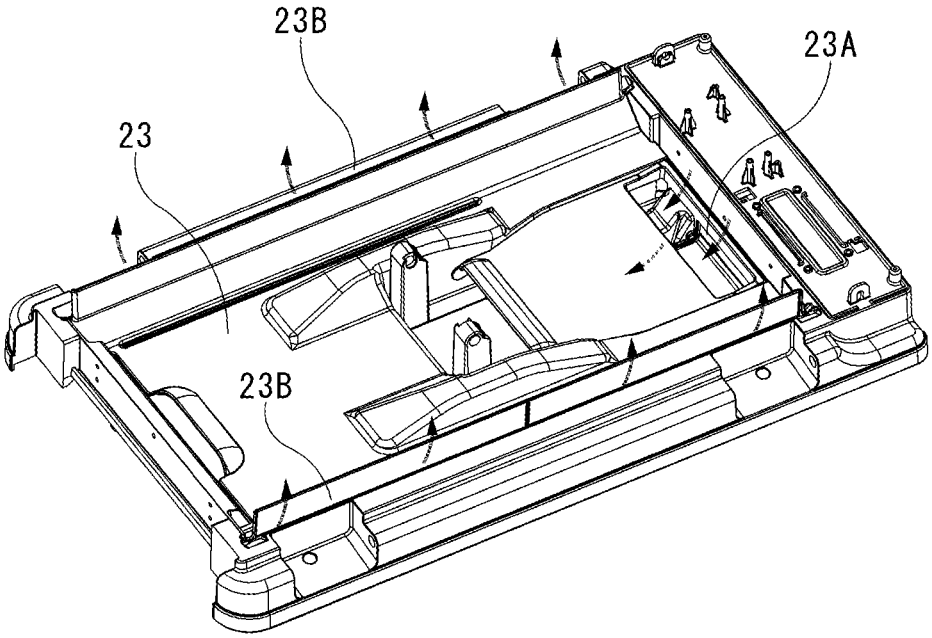
FIG. 5 is a perspective view illustrating the incubator in a state where a floor plate is exposed by removing a bed base located in a lower portion of a baby accommodation chamber.

FIG. 5 illustrates a state where the floor plate 23 is exposed by detaching the bed base 22 and the respective treatment doors 24. In the incubator 101, the baby accommodation chamber 16 and the air conditioner 27 are isolated from each other by the floor plate 23. The harmonizing tank 26 is formed below the floor plate 23. The air is fetched from the baby accommodation chamber 16 to the harmonizing tank 26 through an opening portion 23A disposed close to a rear side (right side in FIG. 2) on the floor plate 23. The air whose temperature and humidity are harmonized in the harmonizing tank 26 is supplied from the harmonizing tank 26 to the baby accommodation chamber 16 through an opening portion 23B disposed in both side portions of the floor plate 23.

Figure 6:
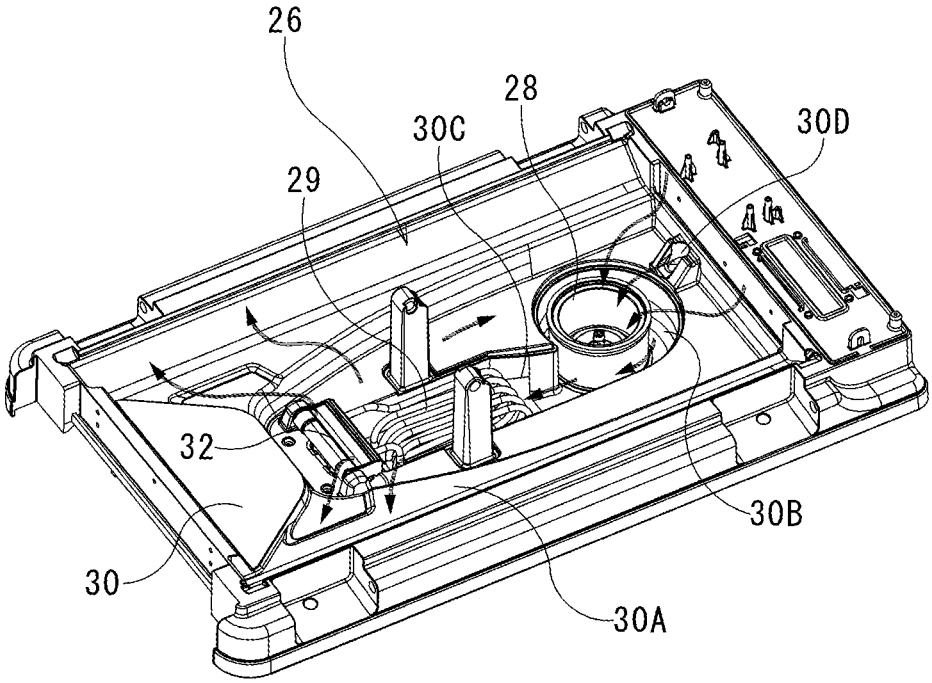
FIG. 6 is a perspective view illustrating the incubator in a state where a harmonizing tank and an air conditioner are exposed by removing the floor plate of the baby accommodation chamber.

FIG. 6 illustrates a state where the floor plate 23 is further detached therefrom. The harmonizing tank bottom plate 30 located in a lower portion of the floor plate 23 has a first recessed portion 30A disposed so as to form a space with a lower surface of the floor plate 23, a substantially cylindrical second recessed portion 30B further recessed from a bottom surface of the first recessed portion 30A so as to accommodate the fan 28, and a substantially rectangular third recessed portion 30C formed continuously with the second recessed portion 30B along a longitudinal direction (forward-rearward direction) of the incubator 101 so as to accommodate the heater 29. In addition, an external air inlet 30D is disposed in the vicinity of the second recessed portion 30B of the harmonizing tank bottom plate 30. Furthermore, in front (downstream side) of the third recessed portion 30C of the harmonizing tank bottom plate 30, a steam introduction port 32 connected to the humidifier 40 is disposed by penetrating in a substantially upward-downward direction of the harmonizing tank bottom plate 30 extending in a substantially horizontal direction.

In the harmonizing tank 26 formed between the harmonizing tank bottom plate 30 and the floor plate 23, the air inside the baby accommodation chamber 16 which is suctioned from the guide pillars 18 and 19 by the fan 28 and external air supplied from the external air inlet 30D are introduced to the second recessed portion 30B through the first recessed portion 30A. Then, the air flows into the third recessed portion 30C from the second recessed portion 30B, and is heated by the heater 29. Furthermore, the air is humidified by the steam supplied from the humidifier 40 through the steam introduction port 32. Thereafter, the humidified air is supplied into the baby accommodation chamber 16 through the first recessed portion 30A from between the floor plate 23 on a lateral side of the baby accommodation chamber 16 and the harmonizing tank bottom plate 30. In FIG. 7, a flow of the air in the air conditioner 27 configured to include the harmonizing tank 26 formed by the floor plate 23 and the harmonizing tank bottom plate 30, the heater 29, and the humidifier 40 is indicated by an arrow.

Figure 8:
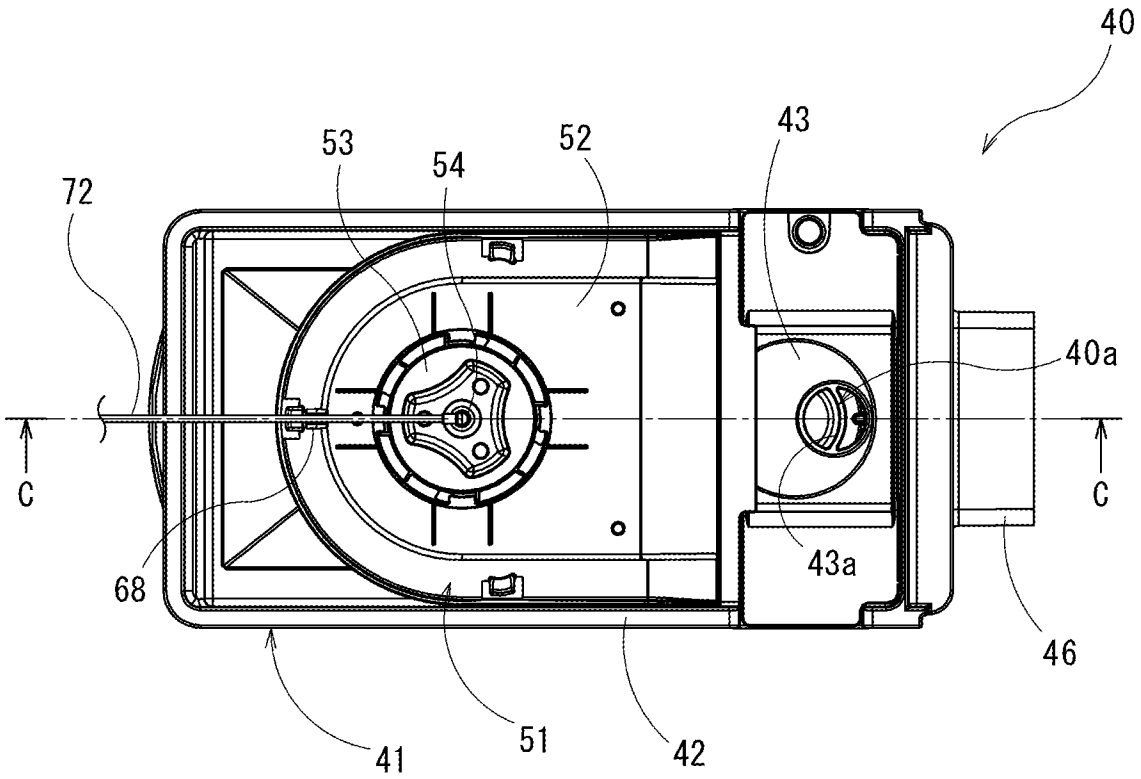
FIG. 8 is a plan view illustrating a humidifier to be installed in the air conditioner of the incubator illustrated in FIG. 1.
Figure 9:
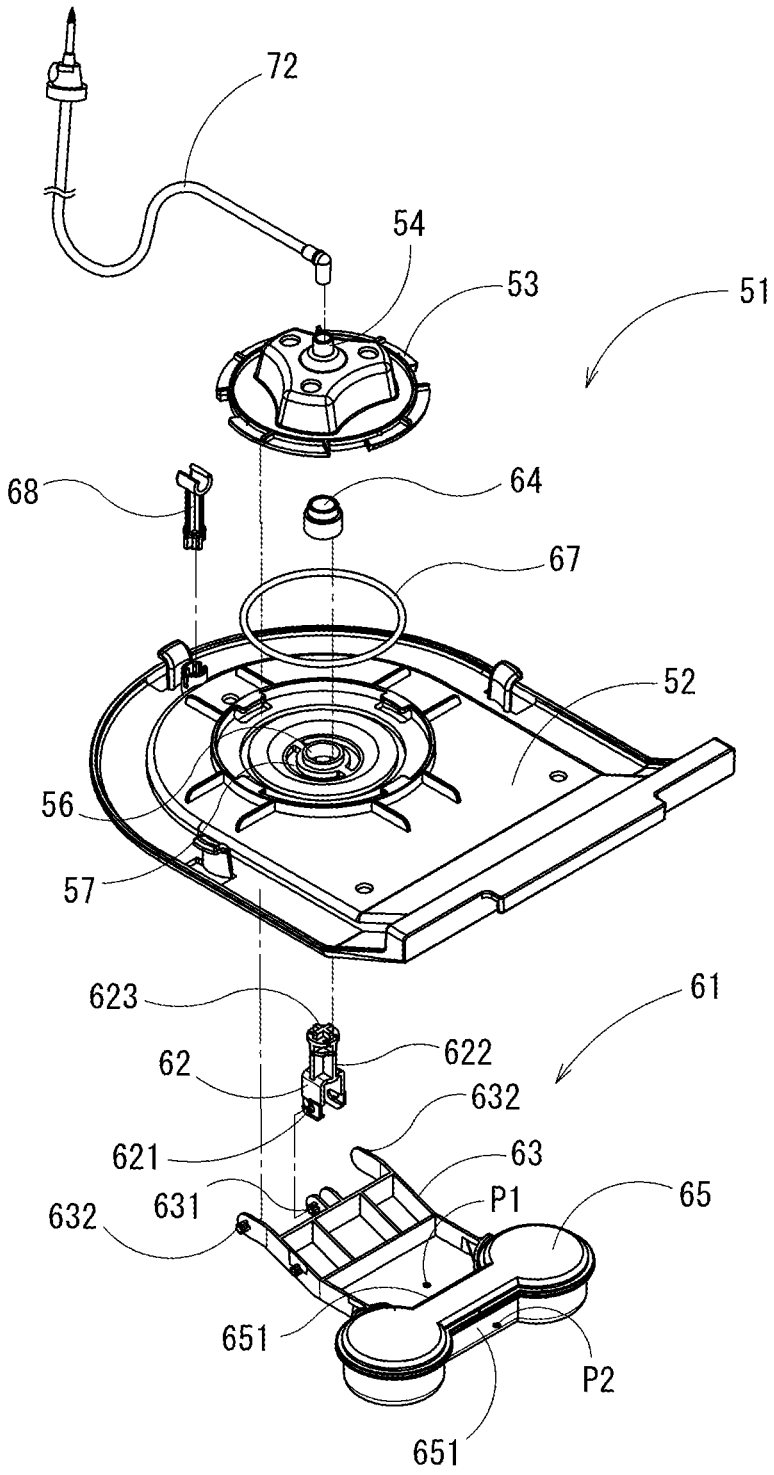
FIG. 9 is an exploded perspective view of a lid portion of the humidifier illustrated in FIG. 8.
Figure 10:
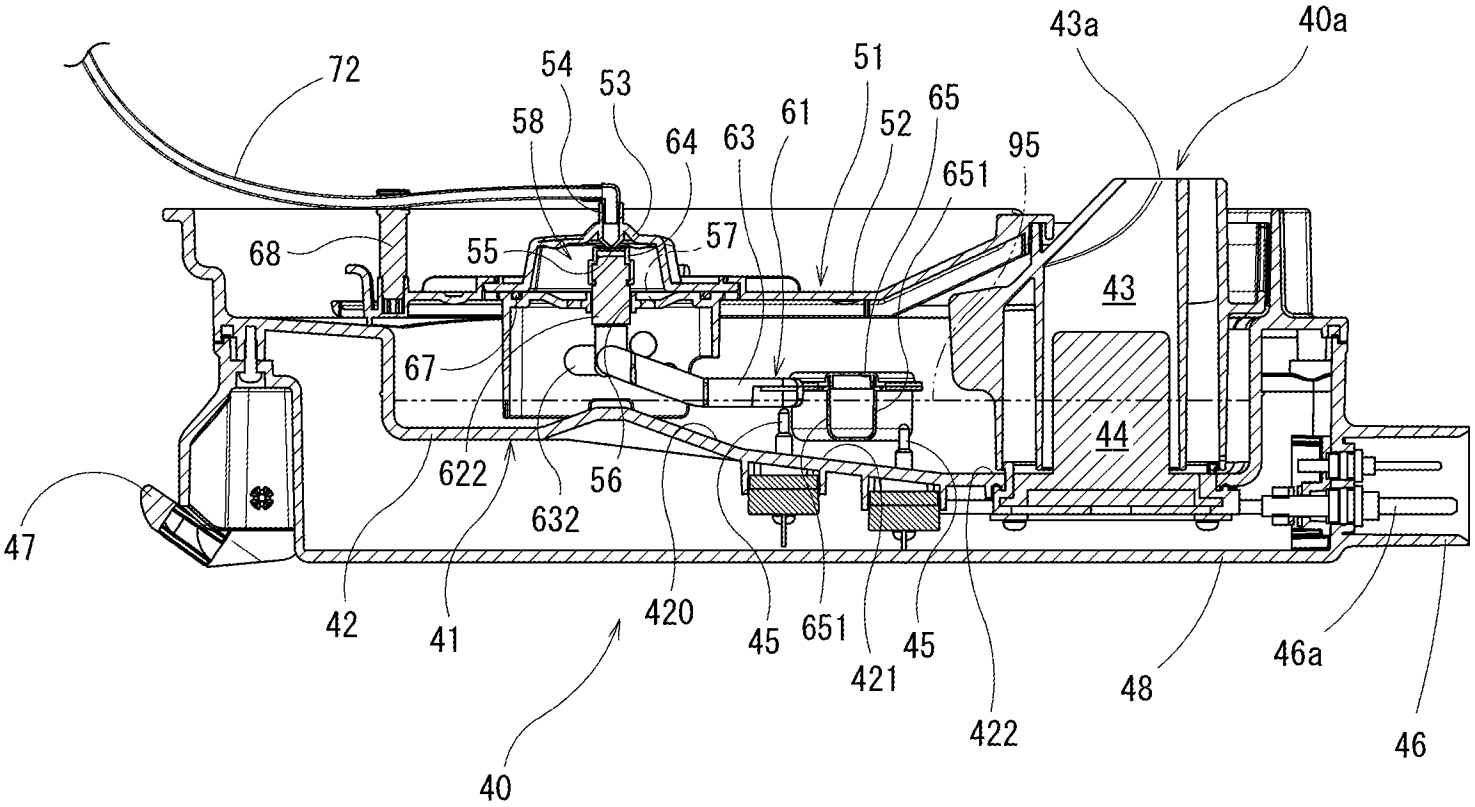
FIG. 10 is a sectional view taken along line C-C of the humidifier illustrated in FIG. 8.

The humidifier 40 of the air conditioner 27 is illustrated in FIGS. 8 to 10. The humidifier 40 includes a humidifying tank 41 which stores the water for generating the steam, and a lid portion 51 which covers an upper portion of the humidifying tank 41. As illustrated in FIG. 10, the humidifying tank 41 has a recessed water storage 42 which is open upward. A bottom surface portion 420 of the water storage 42 is formed so that the depth of one side portion in the forward-rearward direction is shallow and the depth of the other side portion is deep. An inclined surface 421 is formed between the one side portion and the other side portion. Then, the water supplied into the humidifying tank 41 (water storage 42) can be collected in a deepest portion 422 of the other side portion formed to be deepest in the bottom surface portion 420 of the water storage 42. Then, a steam tower 43 having a steam supply port 40*a* connected to the steam introduction port 32 formed in a downstream side end portion of the third recessed portion 30C of the harmonizing tank bottom plate 30 is attached to the deepest portion 422 of the water storage 42. A cartridge heater 44 is located inside the steam tower 43.

In this humidifier 40, if the water supplied from the water supply unit 70 into the humidifying tank 41 is heated by the cartridge heater 44 located inside the steam tower 43, the generated steam is discharged from the steam supply port 40*a* of the steam tower 43.

Figure 12:
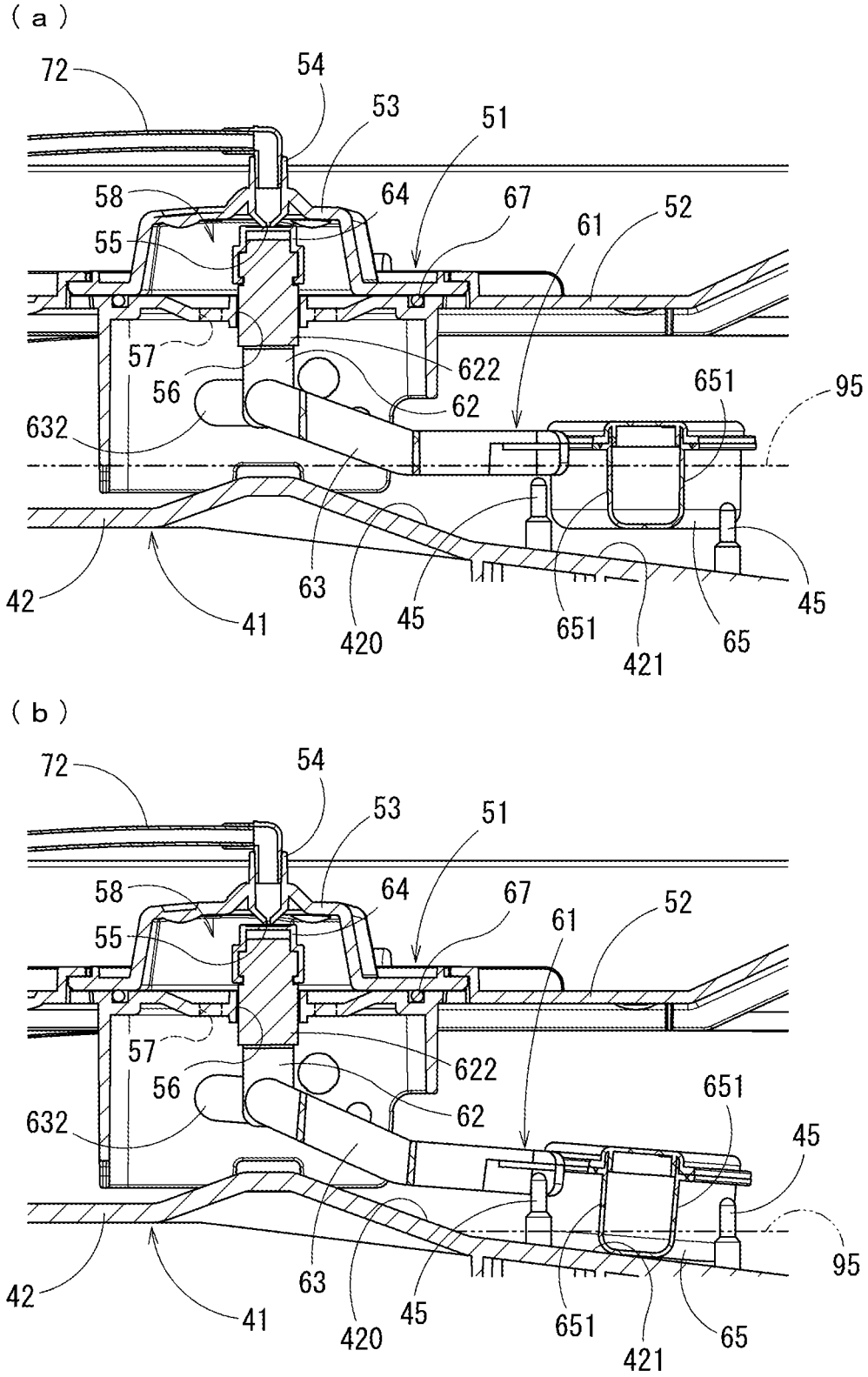
FIG. 12 is a sectional view of a main part of the incubator for describing an operation of a float valve. The part (a) of FIG. 12 illustrates a state where a water supply port portion is closed, and the part (b) of FIG. 12 illustrates a state where the water supply port portion is open.

In addition, the water level sensor 45 for detecting the water level of the water stored inside the humidifying tank 41 is attached to the inclined surface 421 of the water storage 42 of the humidifying tank 41, and checks the water level of the water stored inside the humidifying tank 41 and the amount of the water to be supplied to the cartridge heater 44. In addition, the water level sensors 45 are respectively installed at two positions having the mutually different depths of the water storage 42, and the water level is checked in two stages. As illustrated in FIGS. 10 to 12, the water level sensor 45 attached to the two positions of the inclined surface 421 are the same as each other. In this way, the water level sensors 45 are attached using the inclined surface 421. Accordingly, the respective water level sensors 45 can be easily arranged at the positions having the mutually different depths of the water storage 42. Then, when the water level of the humidifying tank 41 drops below a predetermined water level, in the incubator 101 is controlled so as to issue a warning of an abnormal water level inside the humidifying tank 41 or to stop power supply to the cartridge heater 44.

The lid portion 51 is detachably disposed in the upper portion of the humidifying tank 41, and the water storage 42 can be closed by attaching the lid portion 51 to the humidifying tank 41, and the water storage 42 can be open by detaching the lid portion 51 from the humidifying tank 41. In this case, as illustrated in FIGS. 8 to 10, the lid portion 51 includes a lid main body 52 which covers an upper opening of the water storage 42. The lid main body 52 includes a cover member 53 and a float valve 61. The cover member 53 has a connection portion 54 which can be connected to a water supply hose 72 for supplying the water for generating the steam from a water supply container 71 located outside the base 15, and a water supply port portion 55 which supplies the water into the humidifying tank 41 in communication with the connection portion 54. The float valve 61 is configured to move upward and downward in response to the water level stored inside the humidifying tank 41 so as to open and close the water supply port portion 55.

As illustrated in FIGS. 9 and 10, the lid main body 52 has a guide hole portion 56 which guides the upward and downward movement of the float valve 61, and a communication port portion 57 which is formed around the guide hole portion 56 so as to communicate with a lower surface side from an upper surface side of the lid main body 52. Then, the cover member 53 is detachably disposed on an upper surface of the lid main body 52. In a state where the cover member 53 is mounted on the lid main body 52 as illustrated in FIG. 10, the guide hole portion 56 and the communication port portion 57 are covered by the cover member 53, thereby forming a small space portion 58 between the upper surface of the lid main body 52 and the cover member 53.

The connection portion 54 is formed on the upper surface side of the cover member 53. The water supply port portion 55 communicates with the connection portion 54, and is disposed to be open on the lower surface side of the cover member 53. In addition, as illustrated in FIG. 10, a packing 67 is interposed between the cover member 53 and the lid main body 52. A portion between the cover member 53 and the lid main body 52 is sealed in an airtight manner by the packing 67. Therefore, the water supplied from the water supply port portion 55 does not flow outward of the small space portion 58 from the portion between the cover member 53 and the lid main body 52. The water is smoothly supplied into the humidifying tank 41 (water storage 42) through the communication port portion 57.

As illustrated in FIGS. 9 to 12, the float valve 61 has a guide shaft portion 62 which engages with the guide hole portion 56 of the lid main body 52, and an arm portion 63 having a float 65 formed in the tip portion. A lower end portion 621 of the guide shaft portion 62 and a joint portion 631 of the arm portion 63 are rotatably connected to each other. In this manner, both of these are integrally disposed therein. The guide shaft portion 62 is disposed so that an axial direction thereof is substantially vertical, and an intermediate portion thereof serves as an engagement shaft portion 622 which engages with the guide hole portion 56 of the lid main body 52.

According to the present embodiment, as illustrated in FIG. 9, a cross-section of the engagement shaft portion 622 has a plus shape (+), and the engagement shaft portion 622 engages with the guide hole portion 56 only at four locations on the outer peripheral edge portion. Therefore, a relatively large gap is formed between the engagement shaft portion 622 and the guide hole portion 56. The water supplied from the water supply port portion 55 is supplied not only to the communication port portion 57 but also into the water storage 42 through the guide hole portion 56.

In addition, an upper end portion 623 of the guide shaft portion 62 is disposed so as to protrude from the upper surface of the lid main body 52, and a valve body 64 which can come into contact with the water supply port portion 55 is attached to the upper end portion 623. On the other hand, a lower end portion 621 of the guide shaft portion 62 is disposed so as to protrude from the lower surface of the lid main body 52, and is rotatably connected to the joint portion 631 of the arm portion 63 as described above.

As described above, the arm portion 63 has the float 65 in the tip portion. The float 65 is hollow. As illustrated in the part (a) and the part (b) of FIG. 12, the float 65 moves upward and downward using the buoyancy in response to an increase or a decrease in the water level of water 95 stored inside the water storage 42. In addition, a base end portion 632 of the arm portion 63 is rotatably supported by the lid main body 52, and the arm portion 63 is disposed so as to be rotatable around the base end portion 632 by using the base end portion 632 as the fulcrum. Then, the arm portion 63 is rotatably connected to the lower end portion 621 of the guide shaft portion 62 via the joint portion (point of action) 631 disposed closer to the base end portion (fulcrum) 632 than the float (power point) 65 to which the buoyancy is applied. The guide shaft portion 62 is moved upward and downward in conjunction with the upward and downward movement of the joint portion 631.

As described above, the joint portion 631 of the arm portion 63 is located at a position closer to the base end portion 632 than the float 65 disposed in the tip portion of the arm portion 63. Accordingly, whereas the float 65 greatly moves upward and downward, the joint portion 631 less moves upward and downward as much as a movement amount which is smaller than a movement amount of the float 65. In addition, the guide shaft portion 62 is connected to the joint portion 631 of the arm portion 63. Accordingly, the guide shaft portion 62 moves upward and downward in conjunction with the upward and downward movement of the joint portion 631, and less moves upward and downward than the float 65. Then, the valve body 64 is attached to the upper end portion of the guide shaft portion 62. Accordingly, the valve body 64 moves upward and downward in response to the upward and downward movement of the guide shaft portion 62.

Therefore, as illustrated in the part (a) of FIG. 12, if the float 65 moves upward due to an increase in the water level of the water 95 stored inside the water storage 42, the arm portion 63 is rotated upward around the base end portion 632, and the guide shaft portion 62 is pressed upward via the joint portion 631. Then, the guide shaft portion 62 moves upward with respect to the lid main body 52, and the valve body 64 comes into contact with the water supply port portion 55, thereby closing the water supply port portion 55. On the other hand, as illustrated in the part (b) of FIG. 12, if the float 65 moves downward due to a decrease in the water level of the water 95 stored inside the water storage 42, the arm portion 63 is rotated downward around the base end portion 632, and the guide shaft portion 62 is pulled downward via the joint portion 631. Then, the guide shaft portion 62 moves downward with respect to the lid main body 52, and the valve body 64 is separated from the water supply port portion 55, thereby opening the water supply port portion 55. Therefore, as illustrated in the part (a) of FIG. 12, in a state where the valve body 64 is in contact with the water supply port portion 55, the water supply from the water supply unit 70 is in a stopped state. As illustrated in the part (b) of FIG. 12, only in a state where the valve body 64 is separated from the water supply port portion 55, the water is supplied from the water supply unit 70.

The arm portion 63 has a bilaterally symmetrical shape as illustrated in FIG. 9, and is formed to have a constant width in the rightward-leftward direction. In addition, a pair of the base end portions 632 supported by the lid main body 52 of the arm portion 63 is disposed in the rightward-leftward direction, and is located at an interval therebetween. In addition, the float 65 disposed in the tip of the arm portion 63 is formed to be wider in the rightward-leftward direction. The central portion in the rightward-leftward direction has a recessed portion 651 recessed in the forward-rearward direction orthogonal to the rightward-leftward direction. Then, the water level sensors 45 are respectively arranged inside the recessed portion 651 formed in front of and behind the float 65. In FIG. 9, positions at which the two water level sensors 45 are disposed are indicated by reference numerals P1 and P2. In this way, the recessed portions 651 are respectively disposed in front of and behind the float 65, and the water level sensors 45 are arranged inside the respective recessed portions 651. In this manner, even in a limited space inside the humidifying tank 41, a plurality of the water level sensors 45 can be arranged.

As illustrated in FIGS. 1 and 2, the water supply unit 70 for supplying the water to the humidifier 40 has a water supply container 71 for storing the water and a water supply hose 72 for connecting the water supply container 71 and the humidifier 40 to each other. The water supply container 71 is located outside the base 15, and is formed so that the remaining amount of the water inside the water supply container 71 can be visually confirmed. For example, the water supply container 71 is formed of a transparent member so that an internal state can be observed from the outside. Specifically, the water supply container 71 is formed of polyethylene (PE) or polypropylene (PP).

In the water supply hose 72, one end is connected to the water supply container 71, and the other end is connected to the connection portion 54 disposed in the lid portion 51 of the humidifier 40. Therefore, most of the water supply hose 72 is located outside the base 15, but a portion (other end) is located inside the base 15. A fixing support portion 68 is disposed in the lid portion 51, and the other end portion side of the water supply hose 72 is fixed to the vicinity of the connection portion 54 by the fixing support portion 68. In this manner, even if one end portion side of the water supply hose 72 located outside the base 15 may unexpectedly move, the water supply hose 72 is not easily removed from the lid portion 51. Then, the water supply container 71 connected to the water supply hose 72 is located at a position higher than the water supply port portion 55 of the humidifier 40. A gravity supply method utilizing gravity generated due to the height is used, thereby supplying the water from the water supply container 71 through the water supply hose 72 into the humidifying tank 41.

As illustrated in FIGS. 1 and 2, the incubator 101 according to the present embodiment includes a support rod portion 81 having a hook portion 82 for suspending a medical container such as an infusion bag. The support rod portion 81 is vertically disposed similarly to the guide pillars 18 and 19. Then, the water supply container 71 is suspended by the hook portion 82. In this manner, the water supply container 71 is located at a position higher than the water supply port portion 55 of the humidifier 40, where the inside of the water supply container 71 can be easily viewed by an operator. The water supply container 71 can be used by being attached to a separate device (such as a gator stand) other than the incubator 101.

The humidifier 40 includes a lower container 48 having a substantially tray shape, and the humidifying tank 41 is attached onto the lower container 48. The lower container 48 further includes a power supply connector 46 for supplying power to the cartridge heater 44, and a handle 47 for reliably mounting the humidifier 40 on the base 15 (harmonizing tank bottom plate 30). As illustrated in FIG. 7, the handle 47 is attached so as to be rotatable around an attachment shaft 47*a*, and is rotationally biased in a direction away from the lower container 48 by a torsion coil spring (not illustrated) attached to the attachment shaft 47*a*.

As illustrated in FIGS. 7 and 11, if the base door 31 is closed in a state where the humidifier 40 is incorporated in the base 15, the handle 47 is pressed and rotated by the base door 31 so that the humidifier 40 is biased toward the harmonizing tank bottom plate 30. An upper portion of the base door 31 has a recessed groove portion 31*b* into which the water supply hose 72 can be inserted. In a state where the other end of the water supply hose 72 is connected to the connection portion 54 of the humidifier 40, one end thereof can be pulled out via the base door 31.

When the humidifier 40 is mounted, as illustrated in FIG. 11, the humidifier 40 inserted into the base 15 is pressed to the right in the horizontal direction until a tip of a connector pin 46*a* of the power supply connector 46 comes into contact with the plug 91 disposed inside the base 15. As illustrated by an arrow in the drawing, the base door 31 is closed. Since the base door 31 is closed, the handle 47 is pressed against the base door 31 while being rotated around the attachment shaft 47*a*. The humidifier 40 is moved in the horizontal direction, and is further pressed.

As the humidifier 40 is pressed, as illustrated in FIG. 7, the power supply connector 46 and the plug 91 are connected to each other, and the cartridge heater 44 can be heated. As illustrated in FIG. 11, an upper end surface 43*a* of the steam tower 43 is located below the steam supply path member 92. In this manner, the steam supply path member 92 is pressed up, and further, the steam cap (cap member) 34 is pressed up and opened. In this manner, the steam supply port 40*a* of the humidifier 40 and the harmonizing tank 26 communicate with each other, and the steam can be supplied to the harmonizing tank 26.

On the other hand, when the humidifier 40 is detached, as illustrated by a two-dot chain line in FIG. 11, the base door 31 is opened. In this manner, a claw 31*a* (refer to FIGS. 7 and 11) of the base door 31 is rotated by engaging with a groove (not illustrated) of the humidifier 40. The humidifier 40 is pressed by the claw 31*a*, and is pulled out. The power supply connector 46 disengages from the plug 91. In addition, if the base door 31 is opened, the handle 47 rotationally biased in a direction away from the lower container 48 is rotated, thereby forming a space for finger hooking. The humidifier 40 can be pulled out in the horizontal direction by gripping the handle 47.

The steam tower 43 moves to the left in FIG. 11 by pulling out the humidifier 40. The steam supply path member 92 supported from below by the steam tower 43 is no longer supported from below, and moves downward. In this manner, a steam cap 34 pressed up by the steam supply path member 92 is rotated, the steam introduction port 32 is closed, and the harmonizing tank 26 maintains a state of being shielded from the external air.

Then, according to the incubator 101 configured in this way, if the water level drops after the water 95 stored inside the humidifying tank 41 (water storage 42) is consumed due to the steam generated by the humidifier 40 mounted on the base 15, the float 65 moves downward due to the dropped water level of the water 95 stored inside the humidifying tank 41 as illustrated in the part (b) of FIG. 12. Then, the arm portion 63 is rotated downward around the base end portion 632 due to the downward movement of the float 65. In addition, in conjunction with the joint portion 631 of the arm portion 63, the guide shaft portion 62 moves downward with respect to the lid main body 52. The valve body 64 is separated from the water supply port portion 55, thereby opening the water supply port portion 55. In this manner, the water is automatically supplied into the humidifying tank 41 from the water supply unit 70 (water supply container 71).

On the other hand, if the water is supplied into the humidifying tank 41 and the water level of the water 95 stored inside the humidifying tank 41 rises, as illustrated in the part (b) of FIG. 12, the float 65 moves upward due to the rising water level of the water 95 stored inside the humidifying tank 41. Then, the arm portion 63 is rotated upward around the base end portion 632 due to the upward movement of the float 65. In addition, in conjunction with the joint portion 631 of the arm portion 63, the guide shaft portion 62 moves upward with respect to the lid main body 52. The valve body 64 comes into contact with the water supply port portion 55, thereby closing the water supply port portion 55. In this manner, the water supply into the humidifying tank 41 is automatically stopped.

As described above, the joint portion (action point) 631 of the arm portion 63 is disposed at the position closer to the base end portion (fulcrum) 632 than the float (power point) 65. Therefore, when a weak force (buoyancy) is applied to the float 65, a force stronger than a force applied to the float 65 can be applied to the joint portion 631. Then, the valve body 64 can be pressed against the water supply port portion 55 by using the force stronger than the buoyancy via the joint portion 631. The water supply port portion 55 can be reliably closed, and the water supply can be stopped. Therefore, the water can be prevented from being excessively supplied into the humidifying tank 41.

In addition, the arm portion 63 has the bilaterally symmetrical shape, and the pair of base end portions (fulcrum) 632 is disposed at an interval in the rightward-leftward direction. Accordingly, when the buoyancy is applied to the float 65, it is possible to suppress the inclination of the float 65. Therefore, the arm portion 63 can be stably rotated around the base end portion 632, and the water supply and the water supply stop can be reliably switched by the float valve 61.

Therefore, according to the incubator 101, the water supply port portion 55 can be reliably closed and opened in conjunction with the upward movement and the downward movement of the float 65. In addition, the water supply port portion 55 is opened and closed, thereby enabling the water to be automatically supplied into the humidifying tank 41. Therefore, the water level inside the humidifying tank 41 can be kept constant.

In addition, the water stored inside the water supply container 71 is consumed by water supply into the humidifying tank 41. However, the water supply container 71 is installed outside the base 15. Accordingly, an operator can easily and visually confirm the remaining amount of the water stored in the water supply container 71. Then, when the remaining amount of the water stored inside the water supply container 71 is small, the operator supplies the water to the water supply container 71, or replaces the water supply container 71 with another water supply container having the water stored therein. In this manner, the operator can continuously supply the water to the humidifier 40. Therefore, the operator can continuously supply the humidified air to the baby accommodation chamber 16.

As described above, according to the incubator 101 of the present invention, the water can be supplied to the humidifier 40 from the water supply container 71 located outside the base 15 (incubator main body). Accordingly, without detaching the humidifier 40 from the base 15, the operator can easily supply the water to the water supply container 71, or can easily replace the water supply container 71 with another water supply container having the water stored therein. Therefore, the operator can continuously supply the water to the humidifier 40, and can stably supply the humidified air to the baby accommodation chamber 16.

In addition, the incubator 101 according to the present invention does not need to attach and detach the humidifier 40 to and from the base 15, when the water supply container 71 is replaced. Accordingly, the operator does not touch the humidifying tank 41 of the humidifier 40. Therefore, satisfactory hygienic conditions of the humidifying tank 41 can be ensured, and hygienic air can be stably supplied to the baby accommodation chamber 16. Furthermore, unless the humidifier 40 is detached from the base 15, there is no operation noise or shock caused by the attachment and detachment of the humidifier 40. Accordingly, it is possible to alleviate stress on a baby accommodated in the baby accommodation chamber 16. The humidifier 40 may be detached from the base 15 only when cleaning work is carried out. The humidifying tank 41 can be easily and reliably cleaned and disinfected by detaching the humidifier 40 from the base 15.

In addition, as in the present embodiment, the operator uses the water supply container 71 formed so that the remaining amount of the internally stored water can be visually confirmed. Accordingly, the operator can easily confirm the remaining amount of the water stored inside the water supply container 71. Therefore, the operator can recognize in advance a timing to replace the water supply container 71 without waiting for an alarm. The operator can supply the water to the water supply container 71, and can prepare for replacing the water supply container 71 with another water supply container having the water stored therein. In addition, since the operator can prepare the replacement in this way, the water can be smoothly and quickly supplied to the water supply container 71. Without stopping the water supply to the humidifier 40, the operator easily and continuously supplies the humidified air to the baby accommodation chamber 16.

In addition, according to the incubator 101 of the present embodiment, the water supply container 71 is located at the position higher than the water supply port portion 55 of the humidifier 40. Accordingly, the water can be supplied into humidifying tank 41 by using the gravity supply method utilizing the gravity generated due to the height. Therefore, the water supply unit 70 can be simply configured without providing means for forcibly supplying the water such as a water pump. In addition, the float valve 61 is disposed in the humidifier 40, and the water supply port portion 55 is opened and closed in response to the upward and downward movement of the float valve 61. In this manner, the water can be automatically supplied into the humidifying tank 41. Accordingly, the water level inside the humidifying tank 41 can be kept constant. Therefore, the water can be continuously supplied to the humidifier 40 from the water supply container 71, and the humidified air can be stably and continuously supplied to the baby accommodation chamber 16. The water supply unit 70 can be configured using a water pump.

In addition, the water level sensor 45 which detects the water level of the water stored inside the humidifying tank 41 is provided. Accordingly, when the water level drops below a predetermined water level, a warning is issued so as to inform the operator of the abnormal water level inside the humidifying tank 41. Accordingly, the operator can take various safety measures by reliably supplying the water into the humidifying tank 41 or by forcibly stopping the heating performed by the humidifier 40. Therefore, the no-water heating can be prevented, and the humidified air can be stably supplied to the baby accommodation chamber 16.

The present invention is not limited to the configurations of the above-described embodiment. With regard to the detailed configurations, various modifications can be added thereto within the scope not departing from the gist of the present invention.

INDUSTRIAL APPLICABILITY

The air can be continuously humidified, and the hygienic air can be stably supplied to the baby accommodation chamber.

What is claimed is:

1. An incubator comprising:

an incubator main body;

a baby accommodation chamber disposed in the incubator main body and capable of being shielded from external air; and a humidifier disposed in the incubator main body so as to generate steam for supplying humidified air into the baby accommodation chamber, wherein the humidifier has a connection portion to which a water supply hose is connectable so as to supply water for generating the steam from a water supply container located outside the incubator main body, wherein the humidifier includes:

a humidifying tank which stores the water for generating the steam, a water supply port portion which supplies the water into the humidifying tank in communication with the connection portion, and a float valve which opens and closes the water supply port portion by moving upward and downward in response to a water level of the water stored inside the humidifying tank, wherein the float valve includes a guide shaft portion and an arm portion, wherein the guide shaft portion is disposed substantially vertically in an axial direction, and an upper end portion of the guide shaft portion has a valve body capable of coming into contact with the water supply port portion, wherein the arm portion is disposed to be rotatable around a base end portion by using the base end portion as a fulcrum, a tip portion of the arm portion has a float movable upward and downward by using buoyancy in response to the water level of the water stored inside the humidifying tank, and the arm portion is rotatably connected to a lower end portion of the guide shaft portion via a joint portion disposed at a position closer to the base end portion than the float, wherein the guide shaft portion is disposed so as to be movable upward and downward in conjunction with upward and downward movement of the joint portion, wherein when the float moves upward, the valve body comes into contact with the water supply port portion so as to close the water supply port portion, and wherein when the float moves downward, the valve body is separated from the water supply port portion so as to open the water supply port portion.

2. The incubator according to claim 1, wherein the arm portion has a bilaterally symmetrical shape, and a pair of the base end portions is disposed in a rightward-leftward direction.

3. The incubator according to claim 1, wherein the humidifier includes a water level sensor which detects the water level of the water stored inside the humidifying tank.

4. The incubator according to claim 3, wherein the water level sensors are respectively attached to two positions having mutually different depths of the humidifying tank.

5. The incubator according to claim 4, wherein a central portion of the float in the rightward-leftward direction has a recessed portion formed to be recessed in a forward-rearward direction orthogonal to the rightward-leftward direction, and wherein the water level sensor is located inside the recessed portion.

6. The incubator according to claim 4, wherein a bottom surface portion of the humidifying tank is formed so that the depth of one side portion in the forward-rearward direction is shallow and the depth of the other side portion is deep, and an inclined surface is formed between the one side portion and the other side portion, and wherein the water level sensors are respectively attached to two locations of the inclined surface.

* * * * *